United States Patent [19]

Turley et al.

[11] 4,277,093

[45] Jul. 7, 1981

[54] SAFETY HOOK DEVICE

[75] Inventors: Bernard C. Turley, Pittsburgh; David E. Hochbein, Sarver, both of Pa.

[73] Assignee: Aluminum Company of America, Pittsburgh, Pa.

[21] Appl. No.: 76,213

[22] Filed: Sep. 17, 1979

[51] Int. Cl.[3] ..... B66C 1/36

[52] U.S. Cl. ..... 294/83 R; 294/104

[58] Field of Search ..... 294/67 AB, 83 R, 84, 294/86 R, 91, 103 R, 104; 24/241 P, 241 PP, 241 PL, 241 SB, 241 SP

[56] References Cited

U.S. PATENT DOCUMENTS

| | | | |
|---|---|---|---|
| 408,620 | 8/1889 | Hitchcock | 294/83 R |
| 1,533,995 | 4/1925 | Lang | 24/241 PS |
| 1,888,083 | 11/1932 | Holtz | 294/104 |
| 2,357,054 | 8/1944 | Muddiman | 294/83 R |
| 2,445,106 | 7/1948 | Dempster | 294/83 R |
| 2,860,909 | 11/1958 | Isaac | 294/83 R X |
| 3,929,231 | 12/1975 | Cook | 294/83 R X |

FOREIGN PATENT DOCUMENTS

| | | | |
|---|---|---|---|
| 291813 | 7/1914 | Fed. Rep. of Germany | 294/83 R |

*Primary Examiner*—Johnny D. Cherry

*Attorney, Agent, or Firm*—David W. Brownlee; Max L. Williamson

[57] ABSTRACT

A safety hook device used to couple with objects to be transported overhead is disclosed having a coupling rod at least partially enclosed within a rotatable housing when coupled with the object so that the danger of involuntary uncoupling is lessened. This invention is also adapted to provide for automatic coupling and/or uncoupling.

3 Claims, 8 Drawing Figures

SAFETY HOOK DEVICE

BACKGROUND OF THE INVENTION (1) Field of Invention

This invention relates to a safety hook device that may be used in combination with an overhead transporting means, and the hook device is so adapted that the object to be hoisted and transported may be coupled and uncoupled automatically.

(2) Prior Art

In the transport of objects by overhead cranes or trolleys, it is often desirable that a safety hook be used in order to minimize danger to personnel, damage to the transported object, equipment or other material.

In the electrolytic production of aluminum, for example, large carbon anodes are used, and much of the transportation required in moving the anodes from station to station is by an overhead means. To produce an anode, the carbon is molded and baked into a block using a suitable binder. After baking, the anode block is assembled with a rigid metal bar extending vertically upward from the center of an upper portion of the block. The finished anodes are then transported to a smelting area where the anodes are inserted into an electrolytic cell containing a molten bath of aluminum salt. The rigid metal bar then functions as an electrical conductor and is suspended from a bus bar over the electrolytic cell.

Volume production of aluminum requires the use of large numbers of anodes since the anodes are consumed in the electrolytic process. It is desirable that a hook device be simple and quick to operate and also be provided with a safety feature to prevent involuntary disengagement. Handling and transporting the anodes are significant cost factors in producing aluminum, and speed in engaging, disengaging and transporting is important.

A prior hook device used for transporting anodes is comprised of a hoisting bar having a pin extending outward from a bottom portion of the bar, a slidable movable housing surrounding the bar and pin, and an attaching means on the end of the bar opposite the end having the outward extending pin for the purpose of attaching the hook device to the hoisting cable. To couple an anode bar, the housing is raised so as to be clear of the pin, the pin is inserted through an opening in the anode bar, and the housing is then dropped so as to surround the connection between the hook device and anode bar and thus prevent involuntary uncoupling. An adaptation of this device provides means for automatic raising of the housing and ejecting the pin at the point of desired uncoupling.

Other known safety hook devices include Cook U.S. Pat. No. 3,929,231 which discloses a hook device comprising a rectangular housing having a closed upper end, a movable pin mounted on a support structure attached to the outside of the housing and the pin coaxially aligned with a pair of holes through opposing walls of the housing so that the pin can be inserted through the housing and positive engagement between the pin and the housing obtained thereby. A pin actuating means activated by the crane operator is also provided so that the pin may be inserted and retracted through the holes of the housing walls. To couple an anode bar, the pin actuating means retracts the pin so as to permit entry of an upper portion of the anode bar. An opening through the anode bar is provided, the opening being coaxially aligned with the holes in the housing walls. After the anode bar is properly positioned in relation to the housing, the actuating means causes the pin to be inserted through a hole in the first housing wall, through the opening in the anode bar, and then through the hole in the second housing wall. Involuntary uncoupling is prevented by locking the pin in place through the use of the actuating means. A positive lock is provided by the Cook device, but pin alignment is critical for positive engagement, and since the housing surrounds the upper portion of the anode bar having an opening for the pin, it is not possible to determine visually that the hook device and anode bar are positively coupled.

Muddiman U.S. Pat. No. 2,357,054 relates to a hoisting hook for apertured articles such as plating anodes. The hook portion is formed from a round rod having an elongate vertical shank with an attaching means to a hoisting means on its upper end. The lower end of the rod is bent so as to provide an outward projecting portion that is inserted into an opening in an upper portion of the anode. A latching means attached to a tubular sleeve surrounding the vertical portion of the hook can be raised or lowered by sliding the freely movable sleeve on the vertical portion of the hook. When the latching means is lowered, a bottom portion engages an upper portion of the anode preventing the anode from disengagement with the hook. Since the sleeve does not lock in place, it can be accidentally moved and involuntary disengagement could occur.

Other safety hooks for hoisting devices of interest are disclosed in Grove U.S. Pat. No. 2,986,421, Hohler U.S. Pat. No. 2,537,829, and Elliott U.S. Pat. No. 3,239,266.

It is an object of this invention to provide a hook device that is quick and simple to couple or uncouple from an object to be hoisted.

It is also an object of this invention that the device be provided with a safety feature which will prevent involuntary uncoupling from an object to be hoisted.

It is a further object of this invention that the device may be coupled or uncoupled by an automatic means.

These and other objects and advantages of this invention will be apparent from an examination of the appended drawings and the following description.

BRIEF DESCRIPTION OF THE DRAWINGS

For purposes of illustration, the preferred embodiment of this invention is described for use in the transport of carbon anodes, but it is obvious that it might be employed in the transporting of any object having an opening suitable for attachment to the device as explained hereinafter.

DESCRIPTION OF PREFERRED EMBODIMENT

Figure 1:
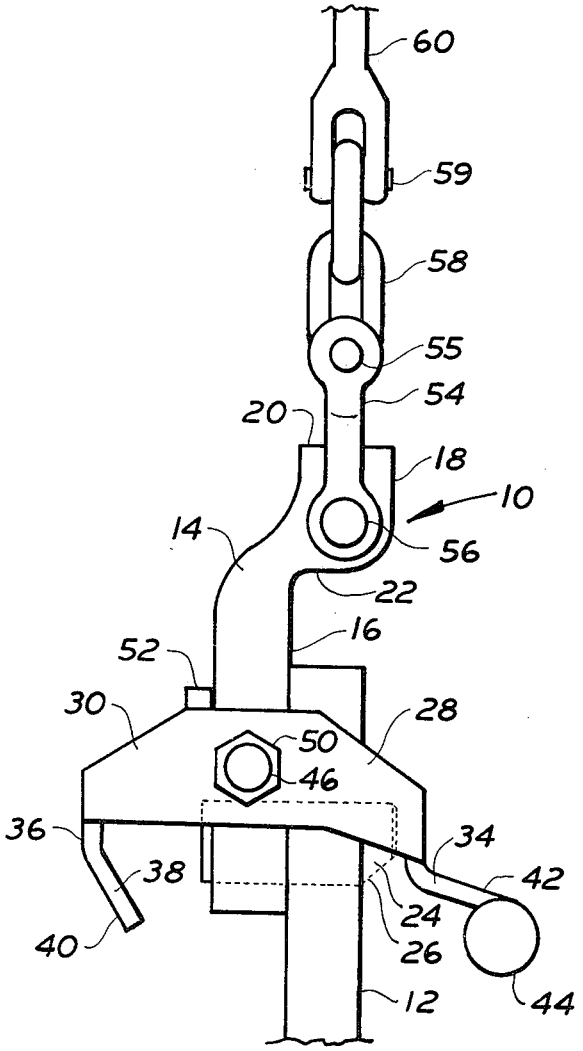
FIG. 1 is a side elevation drawing of a hook device of this invention coupled with an anode bar.
Figure 2:
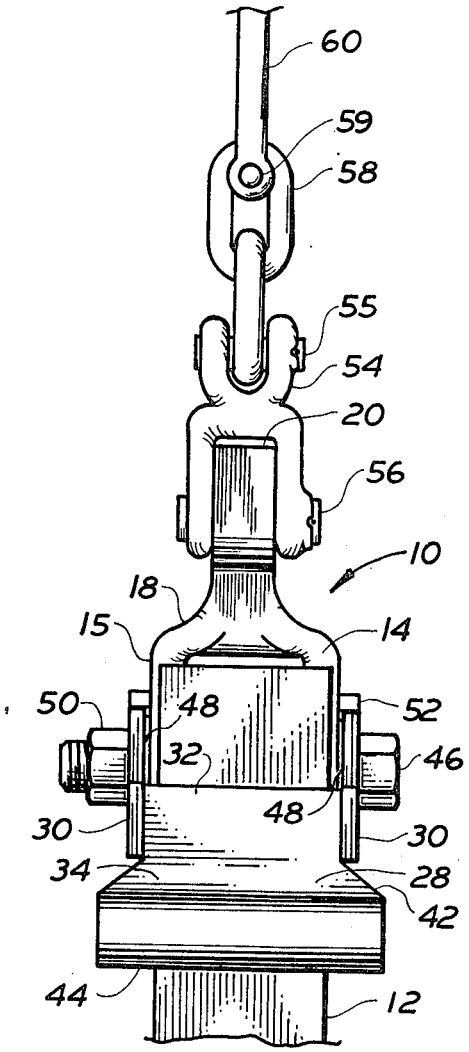
FIG. 2 is an end elevation drawing of a device of this invention coupled with an anode bar.

Referring now to FIGS. 1 and 2, a hook device 10 of this invention is shown coupled with an upper portion of an anode bar 12. The anode bar 12 is rectangular in cross section and extends vertically upward from a carbon anode having the lower end of the bar 12 embedded therein. The hook device includes a frame member 14 which is a casting having a rectangular block base portion 16 and an inverted generally Y-shaped portion 18 with ends of the arms 15 of the Y joined to portions of the top surface of the base portion 16. The stem 20 of the Y-shaped portion 18 is offset by a curved portion 22 from the base portion 16 so that the longitudinal axis of the stem 20 is coaxially aligned with the longitudinal axis of the anode bar 12. A coupling rod 24 extends outward from the center of a bottom portion of the surface on the base portion 16 adjacent to the anode bar 12. The coupling rod 24 is circular in cross section and has a beveled surface 26 on a bottom portion of the end of the rod 24.

A housing 28 has arm members 30 spaced apart on both sides of the base portion 16 of the frame member 14. An upper portion 32 of a first plate 34 is joined on each end to end portions of the inner surfaces of arm members 30 outward of the outermost portion of the coupling rod 24 and a first portion 36 of a second plate 38 is joined on each end to end portions of the inner surfaces on the opposite end of arm members 30. Extending downwardly and inwardly toward the anode bar 12 from the bottom of a first portion of second plate 38 is a second portion 40. Extending downwardly and outwardly away from the anode bar 12 is a second portion 42 of first plate 34. A counterweight 44, which is a rod circular in cross section, is attached longitudinally on a portion of its circumferential surface to a portion of the bottom edge of first plate 34.

A bolt 46 passes through concentrically aligned openings in the arm members 30, frame member 14, and spacer washers 48. The opening through the frame member 14 is of sufficient size to permit the bolt 46 to freely rotate about its longitudinal axis without restriction. Spacer washers 48 are provided between frame member 14 and arm members 30 to insure that clearance is maintained between the frame member 14 and arm members 30 so that the housing 28 and bolt 46 assembly may freely rotate about the longitudinal axis of the bolt 46 without restriction. A nut 50 is tightened on the bolt 46 with sufficient torque to secure the assembly without causing excessive pressure on spacer washers 48 that would restrict rotation of the assembly. The housing 28 is adapted to rotate about the longitudinal axis of the bolt 46 from the force of gravity. An imbalance in portions of the housing extending outward from the bolt 46 is created by making the portion having the first plate 34 and counterweight 44 exceed the weight of the portion having the second plate 38.

A stop bar 52, having a square cross section, is attached to portions of the upper edges of the arm members 30 to restrict the rotation of the housing 28 from the effect of gravity when the housing 28 is in a coupling position as shown in FIG. 1. Although the stop bar 52 is shown in this preferred embodiment as being attached to the housing 28, it could alternately be attached to the frame member 14. Coupling and restriction of rotation of housing 28 will be explained in detail later.

A first shackle 54 is attached to an upper portion of the stem of the Y 18 of the frame member 14 by a fastener means 56 extending through concentrically aligned openings in the bottom end of shackle 54 and frame member 14. A chain 58 having a plurality of links is connected to the first shackle 54 by fastener means 55 extending through concentrically aligned holes in the upper end of the shackle 54 and the bottom link of the chain 58. The other end of the chain 58 is attached to a second shackle 60 by a fastener means 59 extending through concentrically aligned openings in the bottom end of the second shackle 60 and the top link of the chain 58.

The upper end of the second shackle 60 is connected to an overhead transporting means, and thus the shackles 54, 60 and chain 58 provide a flexible linkage between the hook device 10 and the overhead transporting means.

The overhead transporting system may be a trolley mounted on an overhead rail or rails with the flexible chain linkage affixed thereto or it may be an overhead crane having a hoisting means affixed to the flexible linkage.

Figure 3:
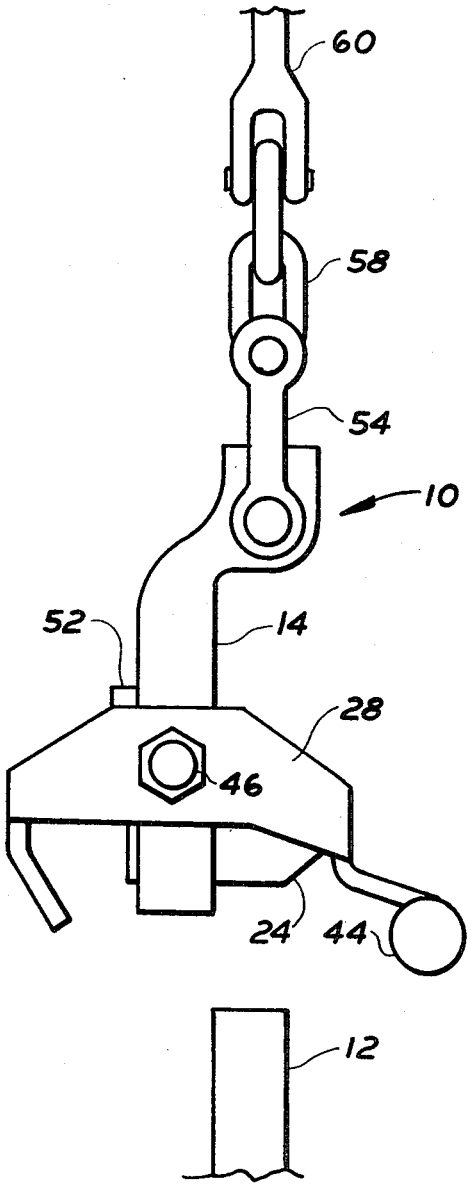
FIG. 3 is a side elevation drawing of a hook device of this invention suspended above the top portion of an anode bar prior to coupling.

To operate an apparatus of this invention, a transporting means attached to the hook device 10 through the flexible linkage comprising the first and second shackles 54, 60 and chain 58 is positioned over the anode bar 12 as shown in FIG. 3. The housing 28 is in a horizontal or coupling position in relation to the vertical frame member 14, and since the counterweight 44 and other portions of the housing 28 on the counterweight side of the bolt 46 exceed the weight of those portions of the housing 28 on the opposite side of the bolt 46, and a portion of the vertical inner surface of bar stop 52 is in contact with a portion of an outer surface of frame member 14, the housing 28 is maintained in its essentially horizontal position.

The hook device 10 is then lowered or the anode and anode bar 12 assembly is raised by an elevator (not shown) until the hook device 10 and anode bar 12 are in a position to be coupled with one another.

The housing 28 is rotated counterclockwise by causing counterweight 44 to be raised until coupling rod 24 is accessible for insertion through an opening in anode bar 12. After anode bar 12 has been coupled to the hook device 10 by inserting coupling rod 24 through the coupling opening in the bar 12, the raising force is removed from counterweight 44 and the force of gravity causes the counterweight 44 to drop rotating the housing 28 clockwise until stop 52 strikes the frame member 14. As shown in FIG. 1, the hook device 10 is positively coupled with the anode bar 12 partially contained within the housing 28 and involuntary uncoupling is prevented. The coupling operation as just described is done manually, but as will be explained later, adaptations may be made to provide automatic coupling.

After making a coupling in the aforesaid manner, the elevator is lowered or the hook device raised and the anode and anode bar 12 assembly can be transported to a desired location without fear of uncoupling.

Figure 4:
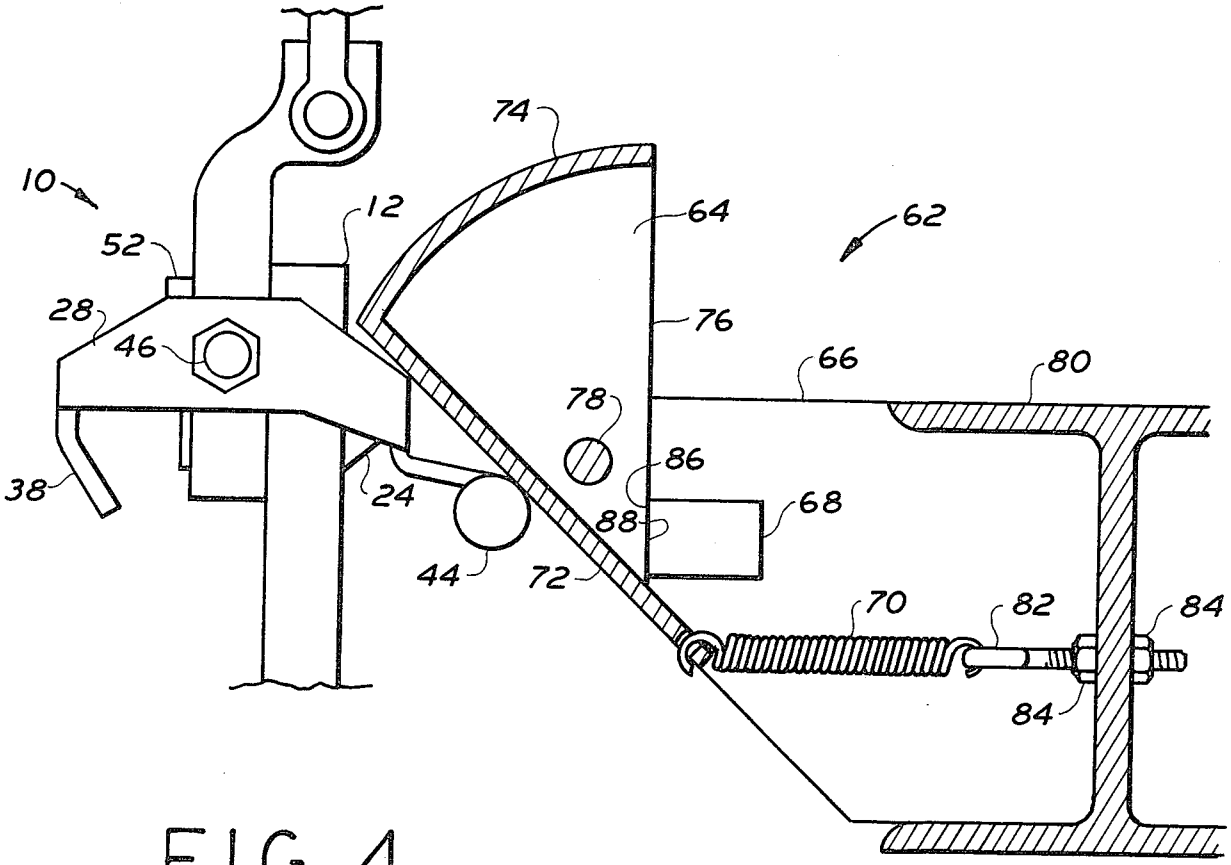
FIG. 4 is a side elevation drawing of a hook device of this invention coupled with an anode bar, and a cross-sectional view of an uncoupling device at the point of beginning the automatic uncoupling cycle.
Figure 5:
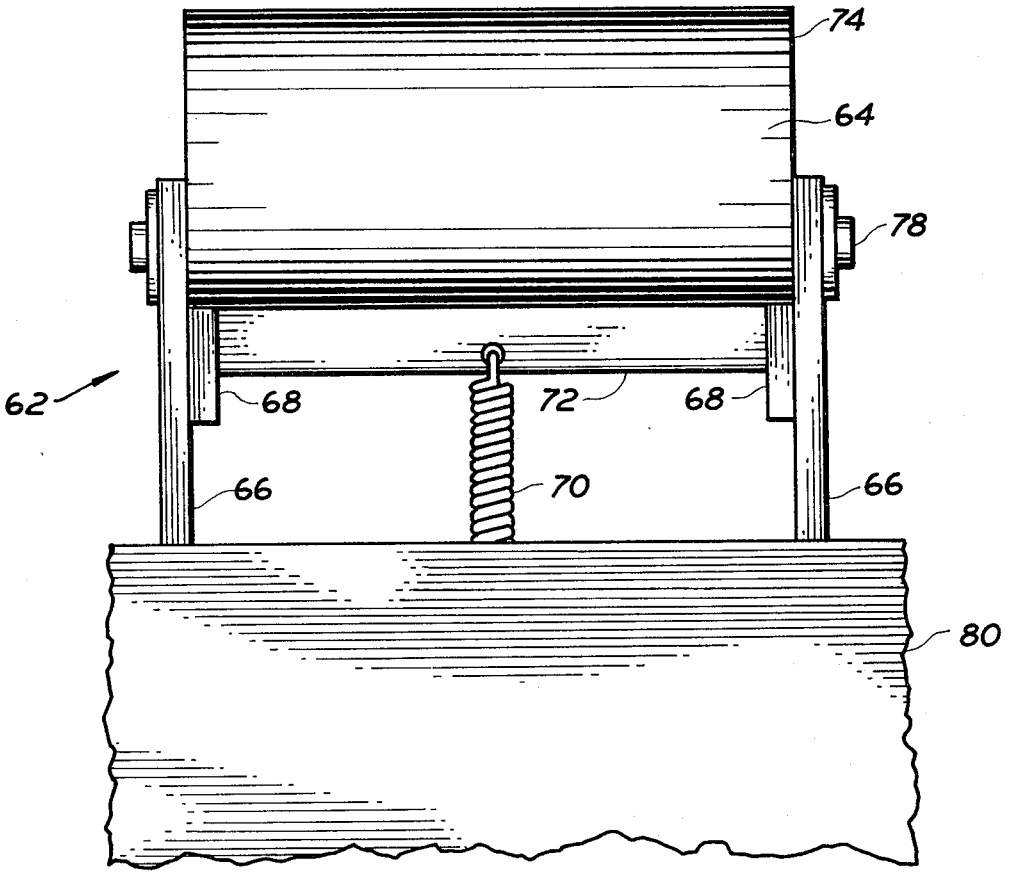
FIG. 5 is a top view of the uncoupling device shown in FIG. 4.
Figure 6:
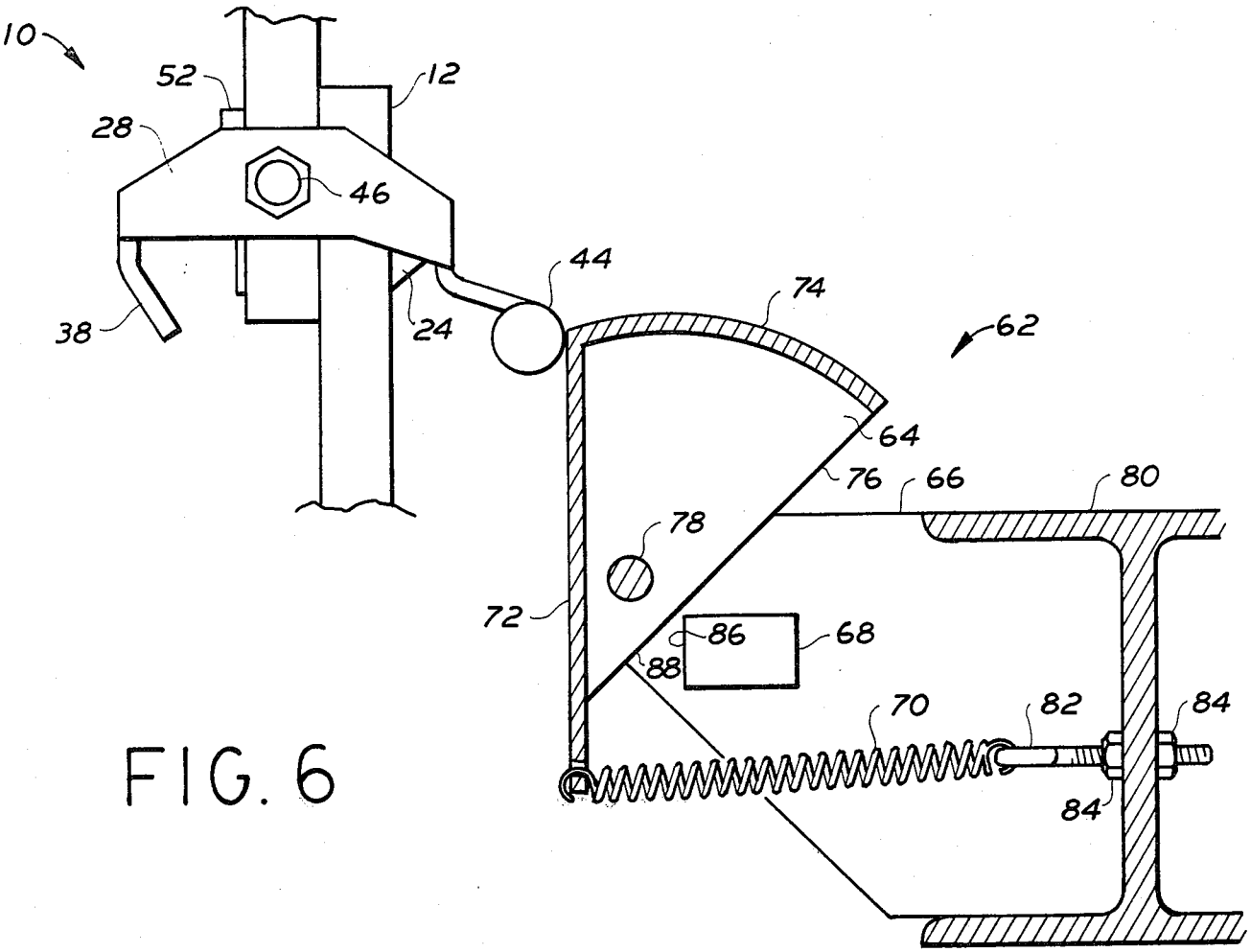
FIG. 6 is a side elevation drawing of the hook device coupled with an anode bar and a cross-sectional view of the uncoupling device at the point of maximum rotation of the uncoupling device during the uncoupling cycle.
Figure 7:
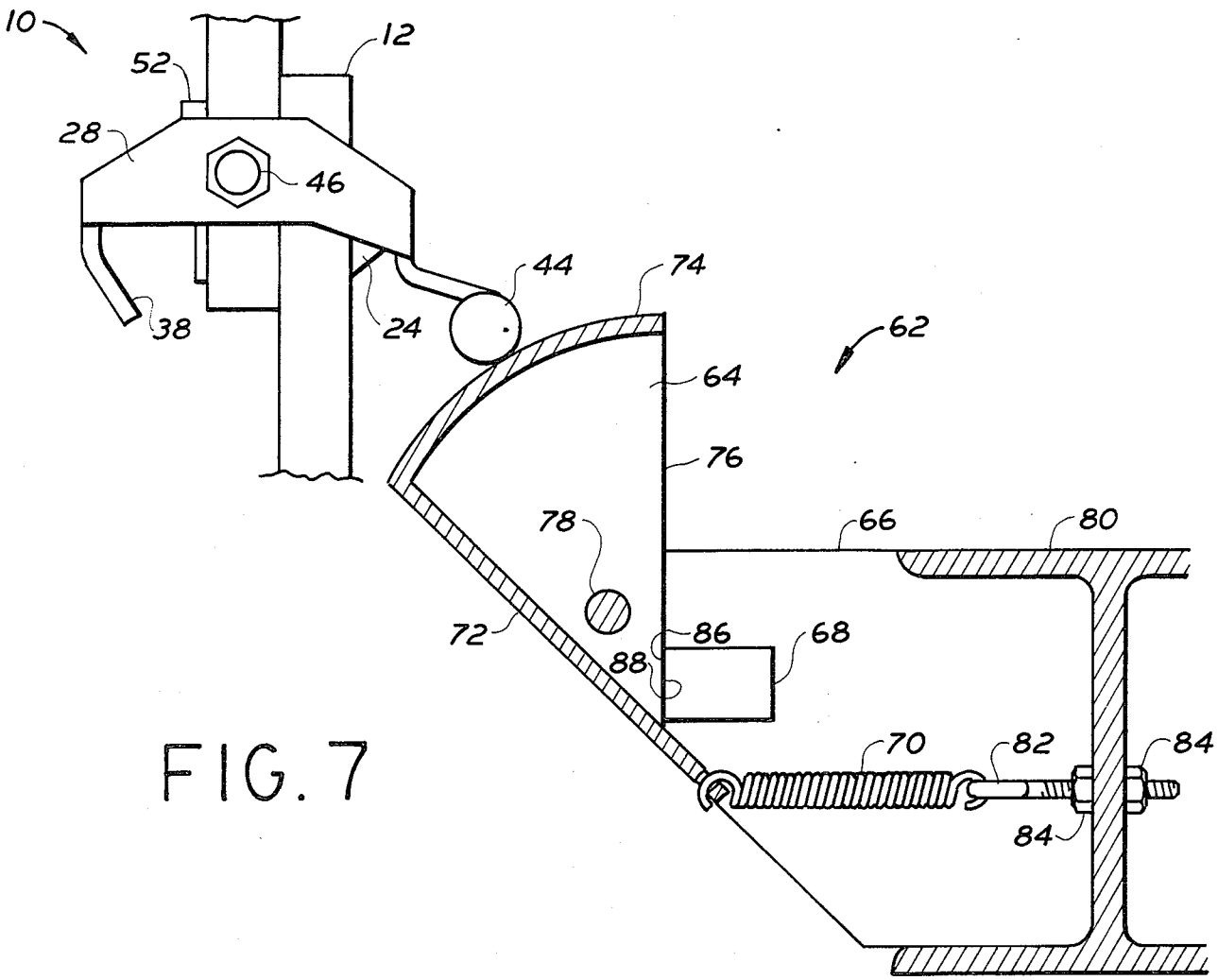
FIG. 7 is a side elevation drawing of the hook device coupled with an anode bar and a cross-sectional view of the uncoupling device after the hook device has cleared the uncoupling device during the uncoupling cycle.
Figure 8:
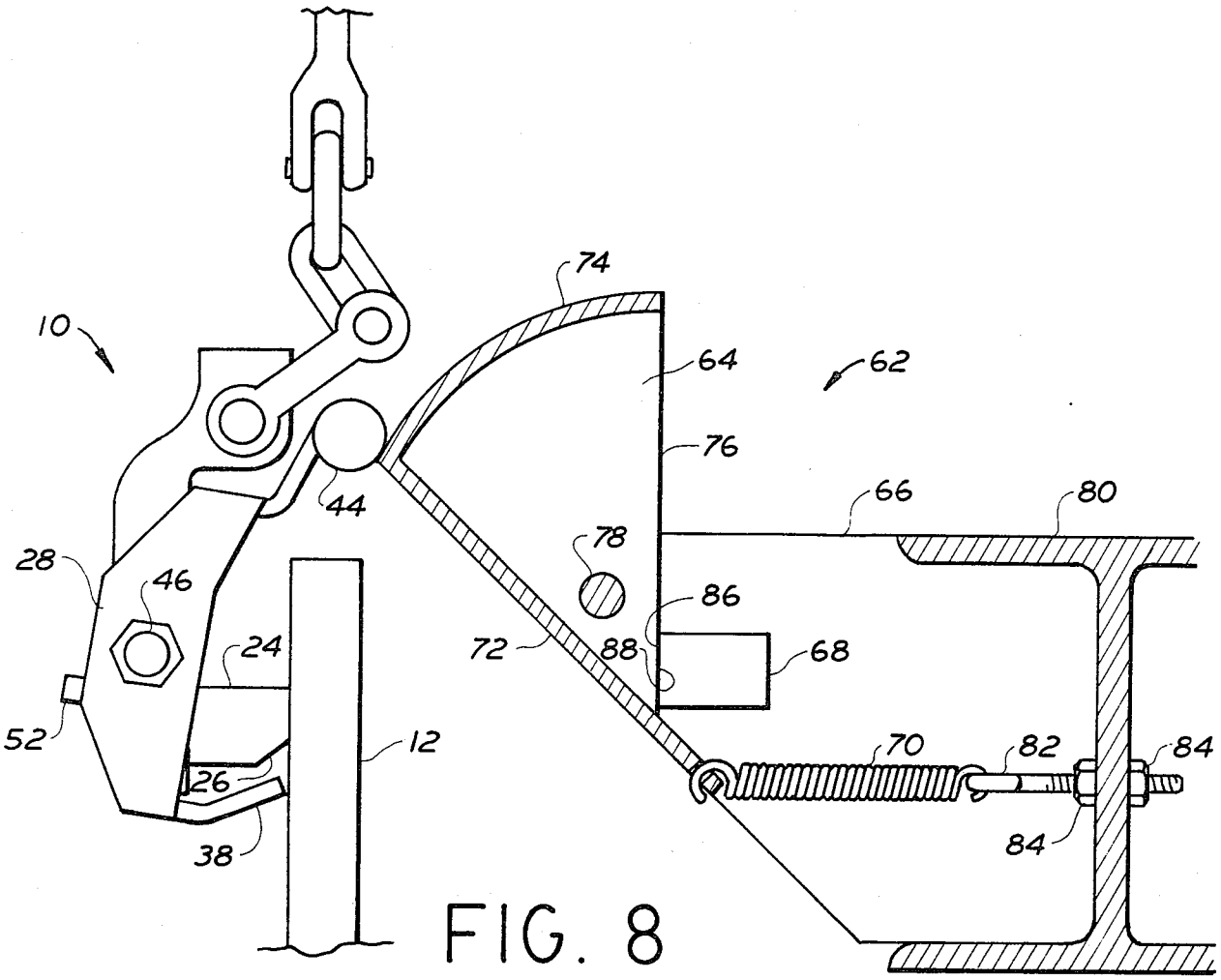
FIG. 8 is a side elevation view of the hook device, anode bar and a cross-sectional view of the uncoupling device at the point of uncoupling in the uncoupling cycle.

A unique feature of this invention is its adaptability for automatic uncoupling, and an example of an uncoupling device and method of uncoupling will now be described. FIGS. 4, 6, 7 and 8 show a hook device of this invention cooperating with uncoupling apparatus at an uncoupling location. FIG. 5 is a top view of the uncoupling apparatus when it is in a position as shown in FIGS. 4, 7 and 8. The uncoupling device 62 comprises an uncoupling cam 64, two spaced apart cam support plates 66, a pair of spaced apart cam stop blocks 68, a cam spring 70, and eye-bolt 82. The uncoupling cam 64 is comprised of a rectangular shaped bottom plate member 72, an arcuate plate member 74, a pair of spaced apart wedge-shaped side plate members 76, and a pivot rod 78. The bottom plate member 72 is joined along its outermost edge to a bottom portion of the inner surface of the arcuate member 74. The side plate members 76 have an arcuate outer edge with a radius equal to the radius of the arcuate plate member 74 and are in a spaced apart relationship attached to the opposing ends of the bottom plate member 72 and arcuate member 74. A pivot rod 78 extends longitudinally through coaxially aligned openings in portions of the side plates 76 near the wedge points and portions of the rod 78 extend through the side plate members 76.

The uncoupling cam 64 is pivotally attached to the support plates 66 by inserting the extended portions of the rod 78 through coaxially aligned openings in outer portions of the support plate members 66 and attaching fastener means on the ends of the rod 78 to prevent longitudinal movement. The support plate members 66 are attached to a structural member 80 along portions of the top and bottom edges and the end edge connecting the top and bottom edge portions of the support members 66. Thus, the uncoupling cam 64 is contained within the support members 66 and is free to rotate about the longitudinal axis of the pivot rod 78.

A spring 70 is attached at one end to a center portion near the inner edge of the bottom plate member 72. The opposite end of the spring 70 is attached to the eye of an eye-bolt 82 which, in turn, is attached to the structural member 80 by retaining nuts 84.

Stop blocks 68 are attached to portions of the inner surface of the support plates 66 and are disposed so that when uncoupling cam 64 is in the uncoupling position as shown in FIGS. 4, 7 and 8, one edge 86 of the stop block 68 bears against a portion of an edge 88 of the side plate 76 and thus prevents the cam 64 from rotating about the longitudinal axis of the pivot rod 78 in a counterclockwise direction from the force of gravity but does not prevent clockwise rotation, as will be explained later.

At the uncoupling location, the uncoupling apparatus 62 is rigidly attached to a support member 80 directly above an elevator means (not shown). The distance between the platform of the elevator means in its lower position and the uncoupling apparatus 62 is sufficient to accommodate the full extent of an anode, anode bar 12 and coupled hook device 10.

To perform the uncoupling operation, the transporting means is used to transport the anode coupled to the hook device 10 to the uncoupling location. As the transporting means approaches the uncoupling location, the anode, anode bar 12 and coupled hook device 10 are positioned in a vertical direction so as to be immediately below the uncoupling device 62 and above the elevator means. Thus positioned vertically, the anode is then moved directly over the elevator means and the elevator is raised so as to come into contact with the anode.

As the elevator is raised, the weight of the load is transferred from the transporting means to the elevator, and the flexible linkage between the transporting means and the hook device 10 is allowed to become slack. As can be seen in FIG. 4, the structure of the hook device permits passage of the portion above the counterweight 44 without making contact with the uncoupling cam 64.

The rising coupled hook device 10 and anode bar 12 strike a portion of the bottom plate 72 with a portion of the counterweight 44 as shown in FIG. 4. Since the housing 28 is restrained from rotating by stop bar 52, the uncoupling cam 64 rotates in a clockwise direction about the longitudinal axis of the pivot rod 78 and flexes spring 70 due to the force of counterweight 44 bearing on plate 72. Rotation of the cam 64 and flexing of the spring 70 continues until the counterweight 44 reaches the outermost edge of the bottom plate 72 as shown in FIG. 6. Further raising of the elevator causes the counterweight 44 to clear the edge of the bottom plate 72 and the flexed spring causes the cam 64 to rotate in a counterclockwise direction until the opposing edge surfaces 86, 88 of the stop blocks 68 and side plates 76 contact one another preventing further rotation and fixing the cam device in the uncoupling position as shown in FIG. 7.

With the portion of the anode bar 12 coupled to the hook device 10 above the uncoupling cam 64, the elevator is then lowered. Since the cam 64 is restrained from rotating by stop blocks 68, continued lowering of the anode load causes the housing 28 to rotate in a counterclockwise direction about the longitudinal axis of the bolt 46. An edge portion of second plate 38 strikes a portion of anode bar 12 which, in turn, causes bolt 46 bearing against the frame 14 to push the frame 14 outward away from the anode bar 12 and withdraw coupling rod 24 from the opening in anode bar 12. FIG. 8 shows the relative positions of the hook device 10 and the cam device 62 at the point of uncoupling. The coupling rod 24 has been withdrawn from the opening in the anode bar 12 a sufficient distance so that only a portion of the rod 12 having the beveled surface 26 remains within the opening, and the counterweight 44 is prepared to clear the outer surface of the arcuate plate 74. When the counterweight 44 clears the surface of the arcuate plate 74, the force of gravity causes the counterweight 44 to fall, rotating the housing 28 in a clockwise direction and coincidentally ejecting the coupling rod 24 from the opening in the anode bar 12 and completing the uncoupling operation.

Although the automatic uncoupling feature of this invention has been described with the coupled assembly of the hook device 10 and anode bar 12 moving vertically in relation to an uncoupling device, it is obvious that other uncoupling means could be employed to accomplish this purpose including an uncoupling means moving vertically in relation to a stationary coupled assembly.

It is also obvious that a means for coupling automatically in a manner similar to the above-described uncoupling operation could be provided if desired. Coupling automatically could be accomplished, for example, by providing a vertical guideway for the hook device 10 above an anode bar at a coupling location. As the hook device is lowered by the hoisting means in the guideway, a cam device similar to the above-described uncoupling device could be positioned in relation to the hook device and anode bar so that the arm member is rotated to permit coupling.

What is claimed is:

1. A hook device for attachment to an overhead transporting means and adapted for automatic uncoupling from a coupled object comprising:

(a) a vertical frame member having an upper portion adapted for attachment to an overhead transporting means and a lower portion having a coupling rod projecting generally horizontally therefrom for inserting into an opening in an object to be transported;

(b) a housing comprising two arm members disposed generally parallel to said coupling rod along opposite sides of said frame member and pivotally attached to said frame member about a horizontal axis with first portions of said arm members extending outward beyond the outermost extent of said coupling rod from said horizontal axis and a second portion extending outward from said horizontal axis in the opposite direction; a first end plate connecting the outer ends of the first portions of said arm members and having a portion projecting downwardly and outwardly from said arm members; a counterweight attached to the projecting end of said first end plate; a second end plate connecting the ends of the second portions of said arm members and having a portion extending downwardly and inwardly from said arm members; and a stop bar attached to second portions of said arm members and having a side surface of said stop bar adjacent to and bearing against said frame member along the side surface opposite said coupling rod; and said housing so adapted that the combination of the first portions of said arm members, said first end plate, and said counterweight are in imbalance about said horizontal axis with and heavier than the combination of the second portions of said arm members, said second plate, and said stop bar.

2. A hook device for attachment to an overhead transporting means and adapted for automatic uncoupling from a coupled object comprising:

(a) a vertical frame member having an upper portion adapted for attachment to an overhead transporting means and a coupling rod projecting generally horizontally from a lower portion of said frame member for inserting into an opening in an object to be transported;

(b) a housing pivotally attached to said frame member about a horizontal axis and having a first portion enclosing at least a portion of said coupling rod for retaining a coupled object on said coupling rod extending outward from said horizontal axis in imbalance with a second portion extending outward from said horizontal axis in the opposite direction and having said enclosing portion heavier than said second portion; and a stop means for preventing gravitational rotation of said housing about said horizontal axis when said enclosing portion encloses said coupling rod.

3. Apparatus as defined in claim 2 wherein said housing comprises: arm members disposed generally parallel to said coupling rod along opposite sides of said frame member and pivotally attached to said frame member; a first end plate connecting outer ends of said arm members beyond the outer end of said coupling rod and having a portion projecting downwardly and outwardly from said arm members; a second end plate connecting outer ends of said arm members opposite the end having said first end plate attached thereto and having a portion extending downwardly and inwardly from said arm members; a counterweight attached to the projecting end of said first end plate; and wherein said stop means is a bar attached to second portions of said arm members and adjacent to and bearing against said frame member along the side surface opposite said coupling rod.

* * * * *